United States Patent [19]

Connelly, Jr.

[11] 4,025,359

[45] May 24, 1977

[54] INHIBITED ACID COMPOSITION FOR CLEANING WATER SYSTEMS

[76] Inventor: George F. Connelly, Jr., Golf Road & Perkins Blvd., Grand Beach, Mich. 49117

[22] Filed: July 3, 1975

[21] Appl. No.: 593,037

Related U.S. Application Data

[63] Continuation-in-part of Ser. No. 456,468, Jan. 1, 1974, Pat. No. 3,969,255.

[52] U.S. Cl. ..... 134/3; 134/22 R; 134/22 C; 252/87; 252/151; 252/181

[51] Int. Cl.[2] ..... B08B 3/08

[58] Field of Search ..... 252/87, 141, 149, 181, 252/146, 151, 148; 134/3, 22 R, 22 C, 41; 210/59, 62

[56] References Cited

UNITED STATES PATENTS

| | | | |
|---|---|---|---|
| 1,470,225 | 10/1923 | Holmes | 252/146 |
| 2,203,649 | 6/1940 | Felkers | 252/149 X |
| 2,380,254 | 7/1945 | McCulloch | 252/146 X |
| 2,959,555 | 11/1960 | Martin et al. | 134/3 X |
| 3,579,447 | 5/1971 | Muzyczko et al. | 252/87 |
| 3,907,699 | 9/1975 | Blair | 134/3 X |

*Primary Examiner*—S. Leon Bashore
*Assistant Examiner*—Marc L. Caroff
*Attorney, Agent, or Firm*—Cook, Wetzel & Egan, Ltd.

[57] ABSTRACT

A pipe cleaning composition containing hydrochloric acid, furfural, dialkylthiourea, and water has a reduced tendency to attack galvanized pipe or steel pipe.

13 Claims, No Drawings

INHIBITED ACID COMPOSITION FOR CLEANING WATER SYSTEMS

The present invention is a continuation-in-part of copending application Ser. No. 456,468 filed Apr. 1, 1974 now U.S. Pat. No. 3,969,255.

The present invention relates to the removal of scale from metal surfaces, and especially to the removal of scale comprising metal oxides and carbonates from interior of galvanized pipes or steel pipes and other galvanized or steel vessels employed for the transport or storage of aqueous fluids. More particularly, the present invention relates to an improved composition for removing scale from such metal surfaces which composition has a reduced tendency to attack the zinc or steel, and is particularly adaptable to the cleaning of scale from the galvanized pipes of portable water systems.

Formation of scale on the interior surfaces of pipes, tubes, coils, tanks, heat exchangers, and other vessels has been a source of trouble where such pipes or vessels come in contact with aqueous liquid. The formation or deposition of scale markedly reduces the heat transfer through walls of such pipes or vessels and furthermore, the capacity of the pipes or vessels and the passage of fluids therethrough is restricted by the formation of such scale. Because of the scale formation on the inner surfaces of the pipes, particularly in the heat transfer appliances, pipes are subjected to excessive heat due to the loss in the heat transfer capacity. Further, greater pressures are required to overcome the restricting effect of the deposited scale. These disadvantages often lead to leaks and rupture which necessitate undesirable down time and maintenance cost. Still further, the reduced cross-section of pipes caused by the deposition of scale can cause increased pressure drop, wherein the water pressure at the top of a multistory building will approach zero.

Numerous attempts have been made to remove scale containing metal oxides and carbonates from the interior of glavanized or steel pipes or fluid confining vessels. The more successful attempts have consisted of using aqueous solutions of known solvents for the compounds commonly found in the scale such as $Fe_2O_3$ and FeS, in combination with acidic materials which can react with the calcium carbonate and calcium oxide which comprises the balance of the scale. The use of hydrochloric acid solutions in concentration from about 1 to 25%, the balance being water, have been proposed, but such aqueous solutions usually lead to serious corrosion problems with respect to the galvanized or steel pipes or water-confining vessels.

Strong acid solutions have been proposed by the prior art to dissolve scale, particularly calcium carbonate scale which is deposited on cooling towers and the metal surfaces of other systems and equipment for handling water. Such systems are designed to handle circulating water for cooling purposes, among other things, and in order to clean the systems the acid cleaning solutions generally must be circulated. The circulation causes aeration of the acid solutions which renders most prior art corrosion inhibitors virtually ineffective.

A common problem encountered in cleaning scale from pipes and small cooling towers and the like is that acid solutions, whether inhibited or not, tend to remove and dissolve copper from the copper surfaces of various elements of the system, and redeposit the copper on the steel surfaces. The presence of dissolved copper in the system is highly undesirable since it tends to plate out and cause severe galvanic attack of steel surfaces.

The present invention overcomes the disadvantages of the prior art through the use of an acid solution containing a combination of inhibitors which provide for reduced corrosion or reduced attack on galvanized and steel surfaces. Using the compositions of the present invention, water systems, and particularly residential water systems fabricated from either galvanized steel can be cleaned and descaled, with a minimum amount of corrosion. The present invention contemplates pipe cleaning compositions which are fundamentally aqueous hydrochloric acid solutions containing a blend of inhibitors including furfural, and diethylthiourea, and use of such compositions to remove scale of the type described above, while significantly minimizing the acid attack on either steel or galvanized steel pipe. In other words, the present invention provides for a composition which will remove scale from galvanized or steel pipes without undue attack on the metal of the pipe, through the use of the novel combination of inhibitors employed in the present invention.

The present invention contemplates pipe cleaning compositions which include hydrochloric acid, furfural, and a dialkylthiourea, the balance of the compositions being essentially water. More particularly, the present invention contemplates a pipe cleaning composition containing from about 7.5 to about 25 parts by weight of hydrochloric acid, 0.6 to 2.6 parts by weight of furfural, and 0.5 to 1.4 parts by weight of dialkylthiourea. In order to obtain the most effective inhibition of galvanized steel corrosion, it is essential to use these components in approximately the ratios set out above. Since the balance of the compositions is essentially water, those skilled in the art will be aware that various ratios of dilution can be used for different purposes, depending upon the type of pipe or water holding vessel which is being cleaned. While it may be desirable to manufacture the pipe cleaning compositions of the present invention at higher concentrations than those set out above, prior to use the compositions should be diluted to the specified levels for most effective use.

It has been found that the addition of inhibitors to levels higher than specified above tends to increase the cost of the pipe cleaning compositions without increasing the effectiveness of the composition. Further, furfural is oily and has a bad odor, and use of more than 2.6 parts by weight (on the basis given above) of furfural tends to cause a film insoluble material to be precipitated on the surface of the pipe being cleaned, which is particularly desirable in domestic water systems. For these reasons, the amount of furfural used in the pipe cleaning composition should be kept as low as possible.

The thioureas of various types are slow to dissolve under some conditions. Therefore the use of higher quantities of thiourea require larger mixing times in the manufacture of the pipe cleaning compositions, and add to the cost thereof without a measurable improvement in the compositions.

As is indicated above, the composition must include a dialkylthiourea. It has been found that diethylthiourea produces the best results, although useful results have been achieved using dimethylthiourea, dibutylthiourea, and diisopropylthiourea. Those skilled in the art will be aware that other dialkylthioureas, similar thioureas such as diphenylthiourea and ethylenethiourea or materials which form such dialkylthioureas in the presence of water and acid may be used.

The preferred composition contemplated by the present invention for use in cleaning or removing scale from residential water systems is as follows:

| | Percent by Weight |
|---|---|
| HCl | about 10.0 |
| furfural | about 1.3 |
| diethylthiourea | about 0.7 |
| water | 87.9 |

In making up the compositions of the present invention, hydrochloric acid of various concentrations can be used, as will be known to those skilled in the art. The commercially available 37% hydrochloric acid has been found to be convenient. In making up the preferred composition, about 26.8 parts by weight of 37% hydrochloric acid are used with the described quantities of furfural, and diethylthiourea, the balance being essentially water. It has been found that this composition not only rapidly removes scale from the galvanized pipe of residential water systems, but is greatly improved over the prior art systems insofar as corrosion inhibition is concerned.

The pipe cleaning compositions of the present invention may be produced by mixing the components in any desired order. It has been found advantageous to mix the acid first with dialkylthiourea, followed by the addition of water. While this mixing step usually gives a clear solution, some dialkyl thiocyanates produce a milky solution. The furfural is then added to the acid solution. The present invention contemplates the use of various mechanical devices for mixing, including high speed dispersers and the like.

The following examples will serve to illustrate the preparation of several pipe cleaning compositions within the scope of the present invention, but it is understood that these examples are set forth merely for illustrative purposes and many other pipe cleaning compositions are within the scope of the present invention.

EXAMPLE 1

A pipe cleaning composition was made up of the following materials:

| | Percent by Weight |
|---|---|
| hydrochloric acid (37%) | 26.78 |
| furfural | 1.30 |
| diethylthiourea | 0.72 |
| water | 69.84 |

The pipe cleaning composition was produced by first mixing the hydrochloric acid with the diethylthiourea. This was then diluted with the given quantity of water and the furfural was added to this solution.

Two control solutions were made up in accordance with the above-described procedure. Control A included all of the components except the diethylthiourea. Control B included all of the components except furfural.

Three pieces of ½ inch galvanized pipe nipples, approximately 3 inches long, were partially submerged in each of the three solutions for 20 minutes, whereafter they were removed and washed with clear water. The nipple which had been placed in the composition of the present invention showed no noticeable removal of the galvanizing from the pipe and showed only slight rust-like corrosion on the threaded area. The pipes which had been submerged in the two control solutions showed complete removal of the galvanizing and substantial oxidation of the threaded portion of the pipe. The pipe which had been in control B, which contained no furfural, showed relatively severe oxidation of the threaded portion of the pipe.

EXAMPLES 2 THROUGH 10

A series of solutions were prepared, within the scope of the present invention, to determine the effect of varying the concentration of inhibitors of the present invention. The solutions described in Table I were made up using 37% hydrochloric acid by first mixing the hydrochloric acid with the diethylthiourea. This was then diluted with the given quantity of water and the furfural was added to this solution. Finally the benzyl thiocyanate was added with vigorous mixing.

A galvanized nipple was submerged for approximately 30 minutes in each of these solutions. The amount of corrosion, as visually determined, is reported in Table I.

TABLE I

| Example | HCl | Furfural | Diethyl-thiourea | Benzyl thiocyanate | Water | Affect on Galvanized after 1 hour |
|---|---|---|---|---|---|---|
| 2 | 60.74 (10.0%) | 2.95 (1.3%) | 1.63 (0.72%) | .24 (0.11%) | 161.23 | least attack |
| 3 | 60.74 (15.4%) | 2.95 (2%) | 1.63 (1.1%) | .24 (0.16%) | 80.61 | minor attack |
| 4 | 60.74 | 5.90 (2.6%) | 1.63 | .24 | 161.23 | very minor attack |
| 5 | 60.74 | 1.48 (0.66%) | 1.63 | .24 | 161.23 | greater attack than 4 |
| 6 | 60.74 | 0 | 1.63 | .24 | 161.23 | great attack |
| 7 | 60.74 | 2.95 | 3.26 (1.4%) | .24 | 161.23 | about equal to No. 2 after 20 minutes |
| 8 | 60.74 | 2.95 | .82 (0.36%) | .24 | 161.23 | rapid attack |
| 9 | 60.74 | 2.95 | 0 | .24 | 161.23 | rapid attack |
| 10 | 60.74 | 2.95 | 1.63 | 0 | 161.23 | minor attack |

The data reported in Table I demonstrates that reducing the amount of either diethylthiourea or the amount of furfural in the acid solution significantly increases the tendency of the solution to attack galvanized steel pipe. Table I also demonstrates that the benzyl thiocyanate is not essential to provide protection against corrosion of galvanized or steel pipe. Table I further demonstrates that increasing the quantities of these materials above the preferred ranges does not significantly reduce the corrosion of the pipe cleaning composition.

EXAMPLE 11A

A pipe cleaning composition was made up of the following materials:

| | Percent by Weight |
|---|---|
| hydrochloric acid (37%) | 26.78 |
| furfural | 1.30 |
| diethylthiourea | 0.72 |
| benzyl thiocyanate | 0.11 |
| water | 69.84 |

The pipe cleaning composition was produced by first mixing the hydrochloric acid with the diethylthiourea. This was then diluted with the given quantity of water and the furfural was added to this solution. Finally the benzyl thiocyanate was added with vigorous mixing.

A control solution was made up, which contained the same ingredients as shown above, but the benzyl thiocyanate was omitted.

The purpose of this test was to determine the relative ability of the two compositions to dissolve the scale, and for this purpose a small piece of flag stone was submerged in each solution. In order to eliminate the possibility that one piece of flag stone was more soluble than the others, the pieces of stone were reversed after 20 minutes.

In each case, 112 grams of the solution of the present invention or the control solution were placed in a small beaker. To each solution was added a piece of flag stone weighing about 100 grams, and after 20 minutes the flag stones were removed, and the weight loss, in grams, was recorded. The flag stone pieces were then placed in the opposite solution, for 15 minutes, and the loss in weight was again recorded. The results of the test are shown in Table II.

TABLE II

| Weight Loss | | |
|---|---|---|
| | Solution of Present Invention | Solution Without Benzyl thiocyanate |
| Stage 1 | 5.7 g (Stone A) | 3.6 g (Stone B) |
| Stage 2 | 2.6 g (Stone B) | 4.8 g (Stone A) |
| Total Loss | 8.3 g | 8.4 g |

EXAMPLE 11B

Using the same solutions as are described in Example 11A, above, the flag stone pieces remaining from the test shown in Example 11A were submerged in fresh solutions (115 grams) for 20 minutes, in the same order as the second phase of the test described in Example 11A. It is believed the weight loss of test 11B can be added to the weight loss in the first portion of test 11A to give a total weight loss based on the use of fresh solutions only. The results of this test are set forth in Table III below.

TABLE III

| Weight Loss - Fresh Solution | | |
|---|---|---|
| | Solution of Present Invention | Solution Without Benzyl thiocyanate |
| Stage 2 | 3.1 g (Stone B) | 4.7 g (Stone A) |

TABLE III-continued

| Weight Loss - Fresh Solution | | |
|---|---|---|
| | Solution of Present Invention | Solution Without Benzyl thiocyanate |
| (fresh solution) Total Loss | 8.8 | 8.3 |

Table III suggests that the pipe cleaning solution of the present invention is about as quick to attack certain types of lime stone or scale as is a similar solution containing no benzyl thiocyanate. It has been found in practical operations that the action of the pipe cleaning solution of the present invention is sufficiently rapid and complete for practical usage, whether or not the solution includes benzyl thiocyanate.

EXAMPLE 12

A pipe cleaning composition as is set forth in Example 11 was made up. This was compared against a composition containing an equivalent amount of hydrochloric acid in water, but with no stabilizers or inhibitors being present. In this case two pieces of flag stone were used, one for each test solution. A piece of flag stone was submerged in one of the compositions being tested for 5 minutes and then removed, its weight loss being recorded. The flag stone was then placed in the other composition, and again the weight loss after 5 minutes was recorded. Finally, the flag stone pieces were returned to the composition they had been placed in initially, and left for 9 hours. Resulting weight losses are shown below in Table IV.

TABLE IV

| Weight Loss | | |
|---|---|---|
| | Composition of present invention | HCl no inhibitor |
| Stage 1 (5 min.) | 1.8 g (Stone A) | 1.65 (Stone B) |
| Stage 2 (5 min.) | 1.25 g (Stone B) | 2.5 (Stone A) |
| Stage 3 (9 hours) | 10.3 g (Stone A) | 14.2 (Stone B) |
| Total Loss | 13.35 g | 19.35 g |

While this experiment shows that the inhibitors of the present invention reduce the speed with which flag stone (and scale) is dissolved, this experiment also demonstrates that the inhibitors do not prevent the acid from working.

EXAMPLE 13

In order to compare the corrosion tendency of hydrochloric acid solutions with the compositions of the present invention, a ½-inch by 2 inches galvanized steel nipple was submerged in a hydrochloric acid solution for about one month and was compared against a similar nipple which had been submerged in the solution of Example 11 (both solutions had the same amount of hydrochloric acid) for one month. The nipple which had been submerged in the hydrochloric acid solution was badly rusted and both ends had been partially eaten away. The nipple which had been submerged in the composition of the present invention was discolored and showed a very small amount of rust, but the nipple was mechanically sound.

The compositions of the present invention are usable in the same manner as the various scale removal solutions of the prior art. This is generally accomplished by pumping the pipe cleaning solution through the pipes of the system being cleaned for an hour or more.

More particularly, in cleaning or descaling a residential water system, the water supply is shut off, and the water removed from the plumbing. A shower head is removed and capped at the highest point of the water system and by opening both the hot and cold valves on the capped shower, the pipe cleaning solution can be pumped up through the cold water system, whereupon it returns down through the hot water system or vice versa. The time of pumping will depend on the concentration of the acid in the pipe cleaning solution and is a function of the amount of scale actually present in the pipe. The actual technique by which this pipe cleaning solution is applied to the pipes is not critical with respect to the present invention although it is preferred to keep the time of contact as short as possible in order to minimize corrosion.

After the scale has been removed using the compositions of the present invention, it may be advisable to neutralize the cleaning pipe. After cleaning out domestic or residential water systems, it is necessary to thoroughly flush the acid and all inhibitors out of the system. In this regard, the present invention contemplates the use of neutralizing agents, baking soda, or the like to neutralize the acid.

In addition to cleaning out residential water systems, the pipe cleaning composition of the present invention is useful in cleaning out humidifiers, vaporizers, shower heads, tea kettles, steam tables, air conditioners and similar water handling apparatus which is susceptible to scale formation. In cleaning out systems which are not used for potable water, it may be desired to mix a small amount of the pipe cleaning solution of the present invention with the water therein in order to inhibit, reduce or eliminate the possibility of scale formation.

The solutions of the present invention may be diluted with water, if desired, for some purposes. It has been found that diluting the pipe cleaning solutions will increase the amount of cleaning solution to be pumped, which may be an advantage if insoluble scale is encountered. In such cases the pumping of the increased volume of pipe cleaning solution will tend to carry the insoluble materials through the pipes, where the solids may be removed by filtration or sedimentation from the pipe cleaning solution. Further, the present invention contemplates that auxiliary materials may be added to the pipe cleaning solutions, such as abrasives or odor absorbers. Still further, one or more organic solvents may be added to the pipe cleaning composition in order to keep one or more of the inhibitors in solution and to help remove or dissolve some of the scale residue.

The pipe cleaning compositions of the present invention are preferably used at ambient temperatures although they may be used at elevated temperatures, if desired. While the use of elevated temperatures increases the speed with which the pipe cleaning composition acts, the advantage of the increase in speed is offset by the cost and trouble involved heating the cleaning composition and the pipe through which it is pumped.

As used herein, the term "parts by weight" shall not necessarily equal the percent by weight, except wherein so stated. Due to the nature of the present invention, the compositions may be diluted to alter the inhibitors or acids outside of the specified ranges, if said ranges were construed as percentages. Since the amount of water used in connection with the pipe cleaning compositions of the present invention may very considerably, the ratios are expressed in parts by weight.

The forms of invention herein shown and described are to be considered only as illustrative. It will be apparent to those skilled in the art that numerous modifications may be made therein without departure from the spirit of the invention or the scope of the appended claims.

I claim:

1. A composition for cleaning galvanized and steel pipe which composition comprises an aqueous solution containing from about 7.5 to 25 parts by weight of hydrochloric acid, and a combination of inhibitors consisting essentially of 0.6 to 2.6 parts by weight of furfural, and 0.5 to 1.4 parts by weight of a dialkylthiourea.

2. A composition for cleaning galvanized and steel pipe as described in claim 1, wherein the dialkylthiourea is diethylthiourea.

3. A composition for cleaning galvanized and steel pipe cleaning which composition essentially consists of:

| | Parts by Weight |
|---|---|
| hydrochloric acid | 7.5 to 25 |
| furfural | 0.6 to 2.6 |
| dialkylthiourea | 0.5 to 1.4 |

the balance consisting essentially of water.

4. A composition for cleaning galvanized and steel pipe as described in claim 3, wherein the dialkylthiourea is diethylthiourea.

5. A composition for cleaning galvanized and steel pipe as described in claim 4, which comprises:

| | Parts by Weight |
|---|---|
| hydrochloric acid | about 10 |
| furfural | about 1.3 |
| diethylthiourea | about 0.7 |

the balance being essentially water.

6. A composition for cleaning galvanized and steel pipe as described in claim 5, wherein the composition contains about 87.9 parts of water.

7. A method of removing a scale deposit from galvanized or steel surfaces normally in contact with water, which deposit includes at least one of alkaline earth metal carbonate, which method comprises contacting said scale deposit with an aqueous composition containing from about 7.5 to 25 parts by weight of hydrochloric acid, and a combination of inhibitors consisting essentially of about 0.6 to 2.6 parts by weight of furfural, and about 0.5 to 1.4 parts by weight of dialkylthiourea, whereby said deposit is dissolved and/or dispersed.

8. A method as described in claim 7, wherein said dialkylthiourea is diethylthiourea.

9. A method as described in claim 7, wherein said composition is continuously circulated in contact with said scale deposit.

10. A method as described in claim 9, wherein said dialkylthiourea is diethylthiourea.

11. A method of inhibiting scale formation in galvanized and steel water systems which comprises adding to the water of said water system an effective scale inhibiting amount of a composition containing from about 7.5 to 25 parts by weight of hydrochloric acid, and a combination of inhibitors consisting essentially of about 0.6 to 2.6 parts by weight of furfural, and about 0.5 to 1.4 parts by weight of dialkylthiourea, and circulating said water throughout said water system.

12. A method as described in claim 11, wherein said dialkylthiourea is diethylthiourea.

13. A method as described in claim 11, wherein said water system is a closed system.

* * * * *